United States Patent [19]

Taylor

[11] 4,238,866

[45] Dec. 16, 1980

[54] RAIN GUTTER CLEANING DEVICE

[76] Inventor: Nelson D. Taylor, 734 Maplewood Ave., Sheffield Lake, Ohio 44054

[21] Appl. No.: 66,440

[22] Filed: Aug. 14, 1979

[51] Int. Cl.[3] ..... A46B 13/02

[52] U.S. Cl. ..... 15/23; 15/92; 56/12.7

[58] Field of Search ..... 15/23, 24, 92, 97 R; 56/12.7

[56] References Cited

U.S. PATENT DOCUMENTS

| | | | |
|---|---|---|---|
| 3,751,749 | 8/1973 | Wilson | 15/92 |
| 4,052,789 | 10/1977 | Ballas, Sr. | 56/12.7 |
| 4,168,559 | 9/1979 | Henson | 15/23 |

*Primary Examiner*—Edward L. Roberts
*Attorney, Agent, or Firm*—Gustalo Nunez

[57] ABSTRACT

A portable, motor-operated cleaning device for removing leaves and other debris from rain gutters on buildings. An electric motor is pivotally mounted on the end of a telescoping rigid tubular handle with the electric cord for the motor extending along the interior of the handle to a switch mounted on the opposite handle end. A plurality of short sections of flexible line are mounted on the motor shaft for rotation with a high velocity by the motor. Each of the sections of line have a preformed configuration having a portion which extends in a generally radially outwardly direction from the shaft and an integrally connected portion which then extends in a generally concavely curved direction toward the direction of shaft rotation. A bracket is mounted on the motor housing and has a pair of rollers which are mounted at right angles with respect to a third roller to provide for rolling engagement with the horizontal and vertical outer edges of a rain gutter. The whirling action of the sections of line in combination with their preformed contour dislodges leaves from the gutter without cutting the same into small pieces. A user of the device walks along the ground below the roof edge and with the extended handle rolls the motor along the gutter on the rollers while energizing the motor by the switch.

10 Claims, 8 Drawing Figures

RAIN GUTTER CLEANING DEVICE

BACKGROUND OF THE INVENTION

1. Field of the Invention

The invention relates to cleaning devices and, in particular, to a motor-operated device for cleaning leaves and other debris from the rain gutters of a house, operable from the ground beneath the gutters. More particularly, the invention relates to a gutter cleaning device using a plurality of preformed, flexible sections of line, which when set into whirling motion by the motor, dislodge the leaves and debris from the gutter without cutting the same, as the device is rolled along the outer edge of the gutter.

2. Description of the Prior Art

Most home owners periodically must remove leaves and other debris from their rain gutters to prevent the same from being washed down the downspouts connected thereto and subsequently clogging the same or the drain tiles leading from the house to a storm sewer or discharge area. This procedure requires an individual using an extension ladder for either climbing onto the roof and subsequently over to the roof edge to manually remove the debris from the gutters, or continually moving the ladder in several foot increments along the house, enabling the individual to reach the gutters while standing on top of the ladder. Both of these procedures are time consuming, strenuous and, more importantly, exceedingly dangerous to the individual, since numerous accidents occur each year to people while working from a ladder around the house.

Various devices have been devised which are placed over the top of the gutters, such as screening or grating, to prevent the accumulation of such debris in the gutter. Also, screen cages are placed at the location of the downspout within the gutter to prevent this debris from entering the downspout. Although these protective screens do retard to some degree the accumulation of debris in the gutters, invariably such materials will eventually accumulate therein, making the cleaning task more difficult by requiring removal of these protective screens prior to removing the debris from the bottom of the gutter. Also, where the house is located adjacent to a number of shade trees, leaves will accumulate over the top of the protective screen, preventing the flow of water into the gutter during a relatively heavy rain.

A recent type of lawn care device which has achieved some degree of popularity consists of an electric or gas-powered motor mounted on a handle having a plurality of strands of line or non-metallic cord mounted on the motor shaft. These cords are rotated in a whirling motion at an extremely high velocity by the motor and will cut grass, weeds and the like when brought into contact therewith. Some examples of these whirling cord cutters are shown in U.S. Pat. Nos. 3,859,776, 4,052,789 and 4,054,992. These types of devices have only found use in the cutting of vegetation and not for other uses.

These vegetation cutting devices use various types of short sections of flexible cords or strings for the cutting blade. Most of these are merely straight, flexible pieces of material which provide a whipping or slashing effect when rotating at the extremely high speeds, which will cut and mangle the vegetation with which it is brought in contact, as intended, due to the relatively straight configuration of the strings. The subject invention modifies and improves such vegetation cutting devices in creating a device for cleaning debris from rain gutters in an extremely safe, easy and inexpensive manner.

There is no known rain gutter cleaning device of which I am aware which enables an individual to remain on the ground beneath the rain gutters while removing debris therefrom by use of motor driven, preformed, flexible lines having a scoop-like configuration enabling the same to dislodge leaves and debris from the gutters without appreciably cutting and mangling the same into small bits and pieces.

SUMMARY OF THE INVENTION

Objective of the invention include providing a rain gutter cleaning device which is used by an individual while standing on the ground beneath the gutters, alleviating the need for a ladder or individual climbing upon the roof with the dangers inherent therewith; providing such a cleaning device using a lightweight, safe, dependable, maintenance-free electric motor on the end of an elongated handle to eliminate the manual work heretofore required for removing debris from the gutters; providing such a cleaning device which has at least two pairs of spaced rollers mounted at right angles with respect to each other on the motor housing, one of which is adapted to rollingly support the weight of the motor on the horizontal outer edge of the rain gutter, with the other roller engaging the vertical edge of the rain gutter as the cleaning device is moved therealong to correctly position the cleaning elements of the device with respect to the bottom and sides of the gutter; providing such an improved cleaning device having a readily collapsible tubular handle enabling the device to be stored conveniently in a compact position when not in use, and in which the electric supply cord for the motor extends through the hollow interior of the collapsible tubular handle for connection to a control switch mounted on the opposite end of the handle from the motor to provide for convenient and easy control of the motor by the user from the ground; providing such a cleaning device which uses special preformed sections of line, preferably formed of monofilament strands of nylon, in which the strands provide a scoop-like configuration so that the whirling strands will tend to scoop or lift the leaves and debris from the gutter without materially cutting or mutilating the same into smaller pieces, thereby making their clean-up considerably more difficult than when uncut and whole; providing such an improved cleaning device in which the motor is pivotally mounted on the extended end of the handle so that it can be positioned at various angles with respect to the handle to permit the user to vary his location away from the house to a position that is comfortable to him without affecting the proper positioning of the motor and its scooping strands with respect to the gutter; providing such an improved cleaning device which consists of a relatively few moving parts, thereby eliminating maintenance and repair problems; and providing such an improved rain gutter cleaning device which is of a relatively simple and efficient construction, which achieves the stated objectives in a simple, effective and relatively inexpensive manner, and which solves problems and satisfies needs in the art.

These objectives and advantages are obtained by the improved rain gutter cleaning device, the general nature of which may be stated as including rigid handle means; motor means pivotally mounted on one end of the handle means and having a rotatable shaft; switch means mounted on the opposite end of the handle means for actuation of the motor means; means mounted on the motor means shaft for securely clamping a plurality of sections of flexible line on the shaft for rotation with said shaft, each of the sections of flexible line having a preformed configuration extending initially in a generally radially outwardly direction and then in a generally concavely curved direction toward the direction of rotation of the shaft; and roller means mounted on the motor means for engagement with the outer edge of a gutter to facilitate movement of the motor means therealong, whereby the sections of line when rotated by the motor means shaft will scoop leaves and other debris from the gutter due to the preformed configuration of the line.

BRIEF DESCRIPTION OF THE DRAWINGS

Further objectives and advantages of the invention will be hereinafter referred to and/or be apparent from the following description of the preferred embodiment of the improved rain gutter cleaning device shown in the accompanying drawings and set forth in the appended claims.

DESCRIPTION OF THE PREFERRED EMBODIMENT

Figure 1:
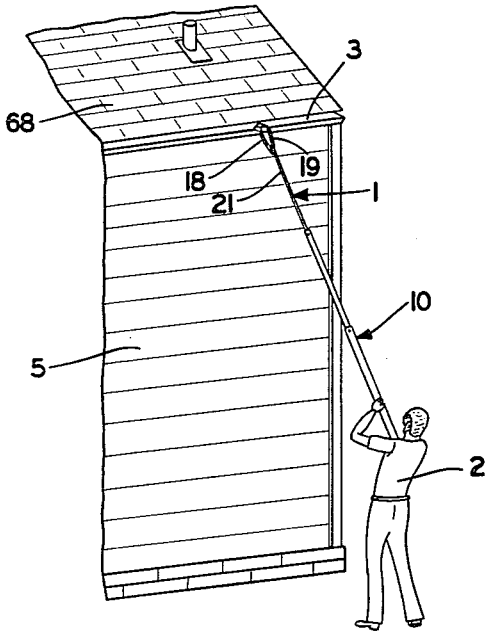
FIG. 1 is a generally diagrammatic perspective view of an individual using the improved rain gutter cleaning device.
Figure 2:
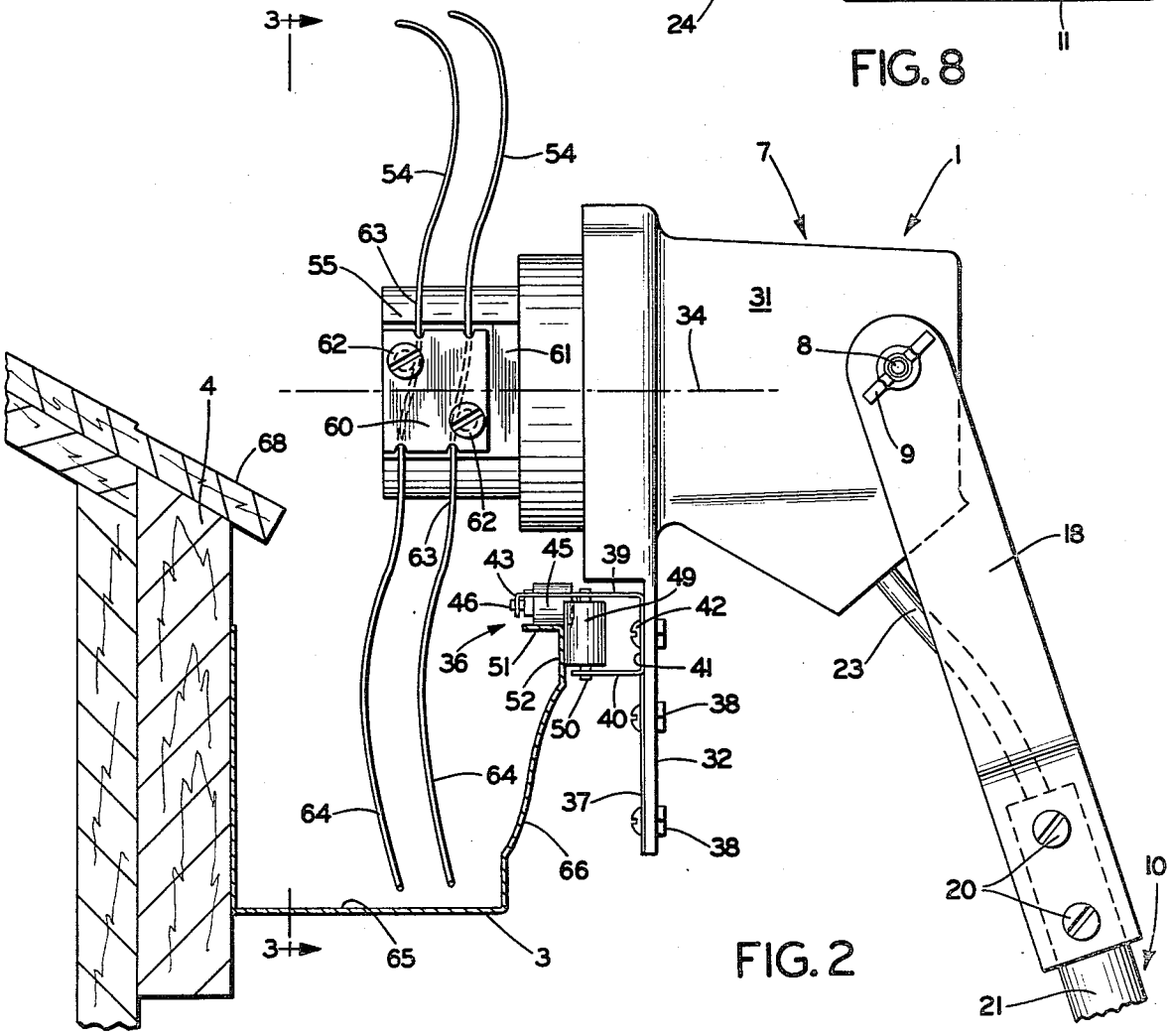
FIG. 2 is an enlarged fragmentary view of the improved cleaning device being shown in use on a rain gutter of a house, with the gutter and house being shown in section.

The improved rain gutter cleaning device is indicated generally at 1, and is shown in FIG. 1 being used by an individual 2 for cleaning a section of rain gutter 3. Gutter 3 is mounted on the fascia board 4 of a house 5, as shown in FIG. 2. Device 1 consists of a motor, indicated generally at 7, which is pivotally mounted by a bolt 8 and wing nut 9 on the upper end of a rigid tubular handle 10.

Figure 8:
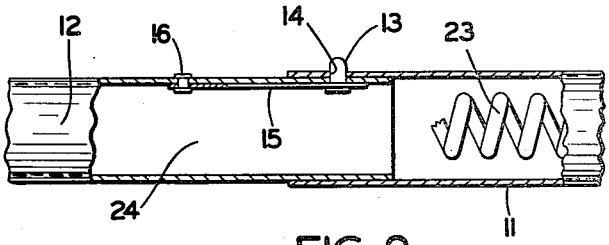
FIG. 8 is a fragmentary view with portions broken away and in section, of two sections of the telescopically joined handle with the electric cord shown therein.

Handle 10 consists of a plurality of telescopically joined tubular sections, a portion of which are shown in FIG. 8 and indicated at 11 and 12. Tube sections 11 and 12, as well as those of the other mating sections, are locked in extended position by a pin 13 which extends through aligned holes 14 in sections 11 and 12 by a strip of spring steel 15 which is attached by a rivet 16 to one of the tubular sections. A pair of flat rigid metal straps 18 and 19 are attached by screws 20 to the top end of uppermost tubular section 21 and pivotally mount motor 7 thereon by bolt 8, as shown in FIG. 2.

Motor 7 preferably will be an electrically operated motor with its power supply cord 23 extending throughout the hollow interior 24 of the tubular sections. Cord 23 preferably will have a coil-like spring configuration which is biased toward a collapsed position so that the cord will collapse or retract automatically when the tubular sections are retracted, eliminating any problems of binding or caring for the supply cord. Cord 23 merely stretches from its coiled condition to a straight position as the tube sections are extended.

Figure 7:
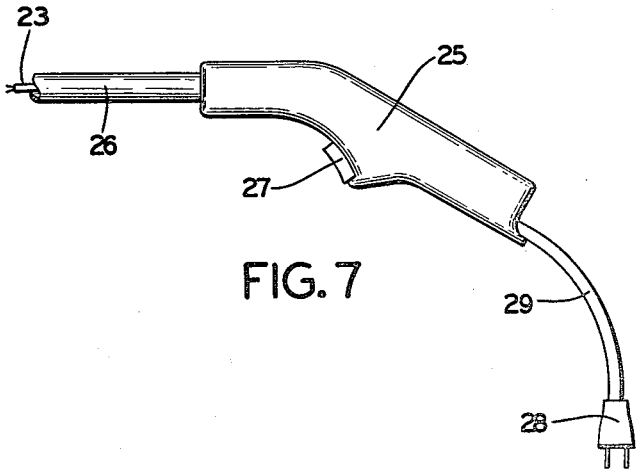
FIG. 7 is a fragmentary plan view of the switch and hand grip portion of the cleaning device handle.

The inner details of motor 7 are not shown, since any type of usual, relatively small electric motor may be used, such as currently being used for the vegetation-type cutters shown in U.S. Pat. Nos. 3,859,776, 4,052,789 and 4,054,992. A pistol-grip handle 25 (FIG. 7) may be connected at the bottom of the endmost tubular section 26 having a finger-actuated switch 27 mounted thereon for controlling the supply of electric power through line 23. An electrical plug 28 and associated cord 29 extend outwardly from handle 25 for insertion into the end of an extension cord which is connected to an outlet in the house or yard for supplying electric power to motor 7.

Figure 4:
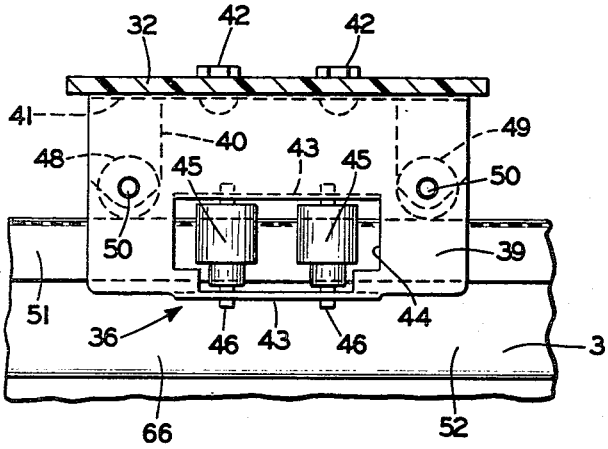
FIG. 4 is an enlarged fragmentary sectional view taken on line 4—4, FIG. 3.

Motor 7 includes a housing 31 having a depending flange 32 extending outwardly from the housing transversely with respect to the axis of the motor shaft 33, which axis is indicated by dot-dash line 34. In accordance with one of the main features of the invention, a roller assembly, indicated generally at 36, is mounted on housing flange 32. Roller assembly 36 includes a mounting bracket having a base plate 37 which lies in abutting engagement with housing flange 32 and is secured thereon by a plurality of bolts 38, and a U-shaped configuration adjacent motor 7, which is formed by a pair of spaced legs 39 and 40 and a connecting web portion 41. Another mounting bolt 42 attaches web 41 to motor housing flange 32 (FIGS. 4–6).

Bracket leg 39, which is located closer to motor shaft 33 than is bracket leg 40, extends outwardly farther from web 41 than does leg 40. Leg 39 is formed with a rectangular-shaped cut-out 44 (FIG. 4) in which a roller 45 is rotatably mounted on a stub shaft 46. Shaft 46 extends through holes formed in spaced depending flanges 43. A pair of rollers 48 and 49 FIG. 4 is mounted at right angles with respect to roller 45 on stub shafts 50 which are received within holes formed in legs 39 and 40. Rollers 48 and 49 are spaced from each other between bracket legs 39 and 40, with roller 45 being located generally midway therebetween (FIG. 4). The axes of rollers 45 and 48–49 form a generally right angle with respect to each other, as shown in FIGS. 2, 4 and 5 and are adapted to engage the outer edge of rain gutter 3, as described below.

Figure 5:
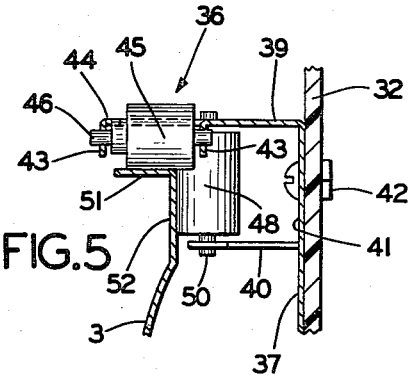
FIG. 5 is an enlarged fragmentary sectional view taken on line 5—5, FIG. 3.
Figure 6:
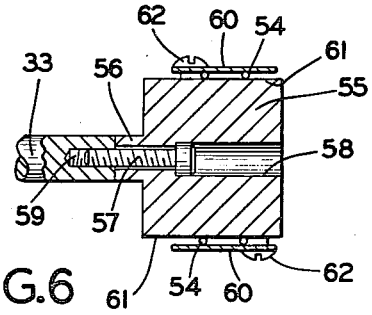
FIG. 6 is an enlarged fragmentary sectional view taken on line 6—6, FIG. 3.

Top roller 45 will roll along a top horizontal edge 51 FIG. 5 of the outer portion of rain gutter 3 to support the weight of motor 7 as cleaning device 1 is moved along the gutter by handle 10. Rollers 48 and 49 are held in abutting rolling engagement with vertical edge 52 of rain gutter 3. Engagement of rollers 48–49 with gutter edge 52 ensures the proper positioning of the cleaning elements of device 1 with respect to the bottom and sides of the rain gutter. Another embodiment of the invention is to have a plurality of rollers 45, see FIG. 4.

In accordance with another of the main features of the invention, a plurality of preformed cleaning elements 54 are mounted for rotation on motor shaft 33. Elements 54 are relatively short sections of line or cord, preferably formed of nylon filament. A rigid block of material 55 having a boss 56 is mounted on the outer end of motor shaft 33 (FIGS. 2 and 6) by a bolt 57 which extends through a counterbore 58 formed in the bottom of block 55. Bolt 57 is threadably engaged within a complementary threaded opening 59 formed in the outer end of shaft 33. Cleaning elements 54 are mounted on block 55 by a pair of diametrically located clamping plates 60 which clamp the lines 54 against flat surfaces 61 of block 55 by attachment screws 62 (FIG. 6).

Figure 3:
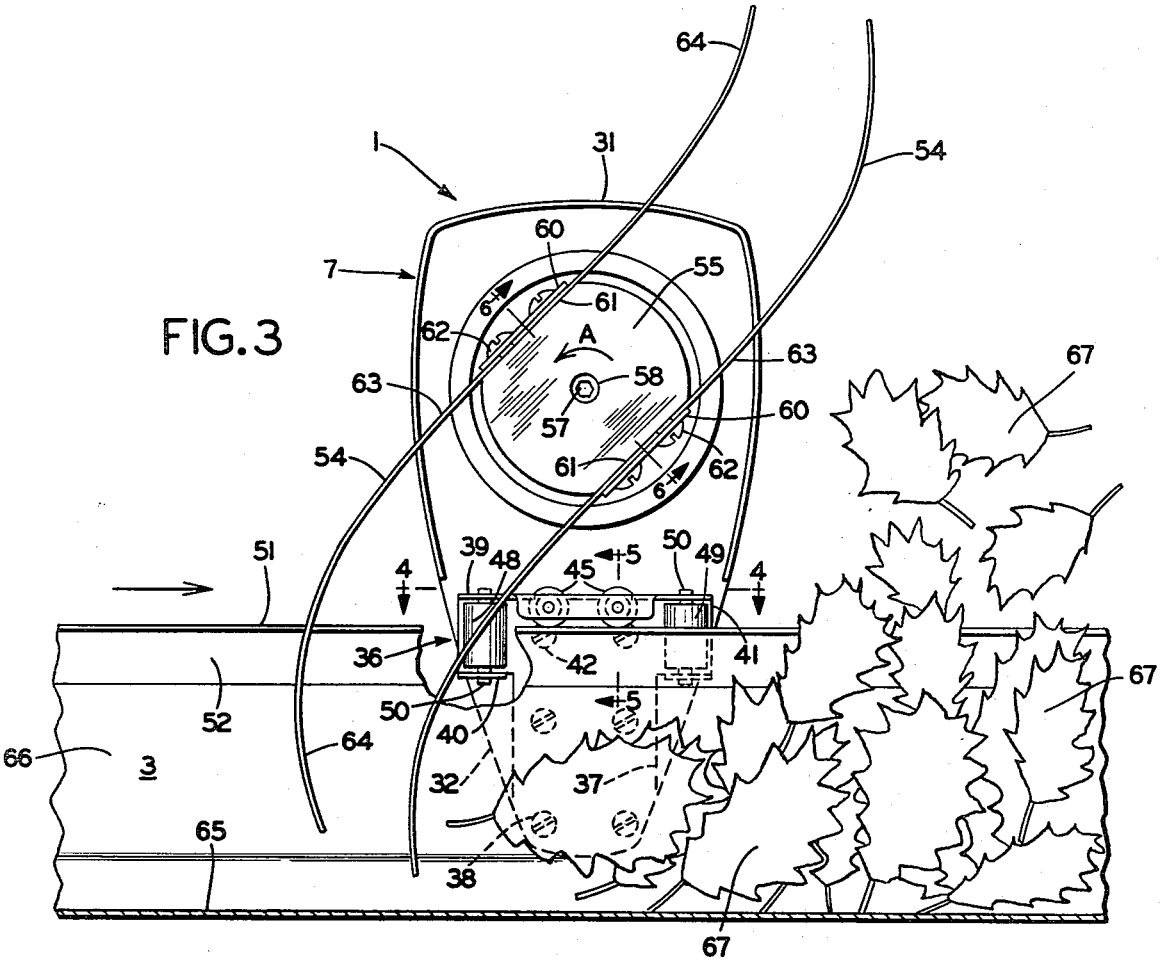
FIG. 3 is an elevational view looking in the direction of arrows 3—3, FIG. 2, showing the improved cleaning device removing leaves from a gutter.

In accordance with another feature of the invention, lines 54 have a preset or preformed scoop-like configuration, shown particularly in FIG. 3, consisting of an initial section which extends in a generally radially outwardly extending direction from mounting block 55, indicated by numeral 63, which then terminates in a concavely curved portion, indicated by numeral 64, which is curved in the direction of rotation of shaft 33, which is in a counterclockwise direction and indicated by Arrow A.

A pair of line sections 54 may be formed from a single strand of material, as shown in FIG. 3, and held in clamped engagement against block 55 by plate 60, or if desired, each section 54 could be a separate piece of line mounted on block 55. The preformed configuration provides a scoop-like effect to the line sections, which when rotated by shaft 33 tends to scoop or pick up the leaves and debris from the bottom wall 65 of rain gutter 3 and discharge the same over the gutter sides 66 without appreciably cutting up or mutilating the leaves. If the line sections were straight as in the vegetation-type cutter, they would have a greater tendency to cut the leaves in pieces, making clean-up considerably more difficult.

The operation of improved cleaning device 1 is readily seen from an inspection of FIGS. 1, 2 and 3. An individual merely rests motor 7 on the gutter 3 by balancing roller 45 on horizontal edge 51 of gutter 3. Switch 27 is depressed, actuating motor 7, causing line sections 54 to rotate or whirl at a high velocity. Cleaning elements 54 will scoop up and discharge leaves 66 from the gutter as the device is manually rolled along the top of the gutter with only a slight amount of force being required by the individual on the ground. A person merely walks along the edge of the house generally beneath the gutter, maintaining motor 7 in its supported engaged position with gutter edges 51 and 52. The operator can quickly deenergize motor 7 by depressing button 27 should the need arise or upon completion of a section of gutter being cleaned, or when encountering one of the spaced gutter supporting nails.

Line sections 54 preferably are formed of a monofilament nylon strand and are heat treated to the preformed or preset configuration, as shown in FIG. 3 and described below. These lines exhibit sufficient flexibility whereby the same will not damage or even mar the gutter or adjacent roof 68 should it come in contact therewith, yet will have sufficient rigidity to maintain their general scoop-like configuration to facilitate the removal and dislodging of leaves 67 from the gutter.

Contact of rollers 48–49 with vertical gutter edge 52 ensures that cleaning line sections 54 are located generally in the center of gutter 3 preventing undue contact with the gutter edges thereby increasing the cleaning efficiency of device 1. Also, the pivotal mounting of handle 10 on motor 7 enables the individual to change his distance away from the house, enabling higher gutters to be reached or to operate device 1 at a position convenient for him or to step farther away from the house to avoid shrubs and other bushes planted close to the house.

Although eight line sections 54 or four continuous strands of preformed nylon filament are shown mounted on block 55 in the drawings, this number may vary depending upon the particular size of the device and its intended application without affecting the concept of the invention. Line sections 54 also are relatively inexpensive and are intended to be disposed of after a period of time, since they may lose their preset configuration and resulting scoop-like action.

Accordingly, the improved cleaning device 1 provides a means for conveniently, easily and simply removing leaves and other debris from rain gutters by an individual without requiring the use of a ladder or climbing on the surrounding roof.

It will be apparent from the foregoing that various other modifications and changes may be made in the structures and their combination described herein without substantially departing from the essential concept of the present invention. Accordingly, it should be clearly understood that the form of the invention described herein and depicted in the accompanying drawings is exemplary only and is not intended as limitations in the scope of the invention as claimed.

I claim:

1. A device for cleaning leaves and other debris from rain-collecting gutters consisting of:

(a) rigid handle means;

(b) motor means pivotally mounted on one end of the handle means and having a rotatable shaft;

(c) switch means mounted on the opposite end of the handle means for actuation of the motor means;

(d) means mounted on the motor means shaft for securely clamping a plurality of sections of flexible line on the shaft for rotation with said shaft;

(e) each of the sections of flexible line having a preformed configuration having a portion extending in a generally radially outwardly direction and then an integrally connected portion extending in a generally concavely curve direction toward the direction of rotation of the shaft; and (f) roller means mounted on the motor means for engagement with the outer edge of a gutter to facilitate movement of the motor means therealong, whereby the sections of line when rotated by the motor means shaft will scoop leaves and other debris from the gutter due to the preformed configuration of the line.

2. The cleaning device defined in claim 1 in which the handle means is a plurality of telescopically joined tubular sections.

3. The cleaning device defined in claim 2 in which the tubular sections are collapsible within each other for compact storage of the device.

4. The cleaning device defined in claim 1 in which the motor means is an electric motor; in which an electric supply cord extends along the handle means from the motor means to the switch means.

5. The cleaning device defined in claim 1 in which the roller means includes a pair of rollers adapted to engage a vertical edge of the gutter and a third roller spaced at generally a right angle with respect to said pair of rollers and adapted to engage a horizontal top edge of the gutter for balancing the motor means on the gutter.

6. The cleaning device defined in claim 1 in which the sections of flexible line are pieces of monofilament nylon.

7. The cleaning device defined in claim 1 in which the flexible line clamping means is a block of rigid material having a central bore; in which the motor means shaft projects into said bore and is secured therein; and in which clip plate means removably mount the sections of flexible line on the block.

8. The cleaning device defined in claim 1 in which the motor means has an outer housing; in which the roller means includes bracket means mounted on the motor means housing, said bracket means having a web wall attached to the housing and a pair of spaced end walls; in which the roller means includes a pair of rollers which are rotatably mounted on and extend between the spaced end walls; and in which one of the end walls is formed with a slot with a third roller being rotatably mounted in said slot.

9. The cleaning device defined in claim 1 in which said motor means is reversible.

10. The cleaning device defined in claim 1 in which said rigid handle means is expandable.

* * * * *